United States Patent [19]

Krywiczanin et al.

[11] Patent Number: 4,582,455

[45] Date of Patent: Apr. 15, 1986

[54] PNEUMATIC TRANSPORTERS

[75] Inventors: Wladyslaw H. Krywiczanin, Eastleigh; Peter Harris, Southampton, both of England

[73] Assignee: British-American Tobacco Company Limited, London, England

[21] Appl. No.: 746,002

[22] Filed: Jun. 18, 1985

Related U.S. Application Data

[63] Continuation of Ser. No. 439,228, Nov. 4, 1982, abandoned.

[30] Foreign Application Priority Data

Nov. 20, 1981 [GB] United Kingdom ..... 8134966

[51] Int. Cl.[4] ..... B65G 53/42

[52] U.S. Cl. ..... 406/108; 406/194

[58] Field of Search ..... 406/88, 108, 153, 191, 406/192, 194; 271/195, 97; 226/97

[56] References Cited

U.S. PATENT DOCUMENTS

| | | | |
|---|---|---|---|
| 1,369,648 | 2/1921 | Gieseler | 406/192 X |
| 2,993,737 | 7/1961 | Stephen | 406/191 X |
| 3,136,539 | 6/1964 | Lyman | 271/195 X |
| 3,614,168 | 10/1971 | Range | 271/97 X |

*Primary Examiner*—Jeffrey V. Nase
*Assistant Examiner*—L. E. Williams
*Attorney, Agent, or Firm*—Kane, Dalsimer, Kane, Sullivan & Kurucz

[57] ABSTRACT

A simple form of pneumatic transporter is provided by making two pairs of lines of cut in the wall of a length of ducting and bending outwardly the portions of the wall between each pair of lines of cut. A nozzle means is mounted at the outer end of each of the bent-out portions.

10 Claims, 4 Drawing Figures

PNEUMATIC TRANSPORTERS

This is a continuation of co-pending application Ser. No. 439,228 filed on Nov. 4, 1982, now abandoned.

This invention relates to pneumatic transporters suitable for use in transporting continuous lengths of web material, including web material of a flimsy nature, cigarette paper for example, or discrete lengths of sheet material, blanks for cigarette packs for example.

Pneumatic transporters are known which comprise a length of ducting and one or more introduction means whereby a gas, air for example, can be introduced into the ducting. One such transporter is described and illustrated in United Kingdom Patent Specification No. 1,338,440, reference to which will show that air introduction means comprises a passage of Venturi form and orifices at the Venturi throat for the supply of air under pressure. The converging nozzle portion, the throat and the expanding nozzle portion of the Venturi form passage are accurately contoured and thus the manufacture of the introduction means necessitates expensive machining operations.

There is described and illustrated in our co-pending United Kingdom Patent Application No. 81.41062 an air transporter, air introduction means of which comprises a block through which extends a Venturi form passage. Outlet slits extend from plenum chambers in the block, whereby air under pressure may be supplied at the upstream ends of the surfaces defining the converging nozzle portion of the Venturi form passage. Again, the machining of the curved surfaces of the passage is costly.

The present invention provides a pneumatic transporter comprising a length of ducting, at an inlet location of which oppositely disposed portions of the ducting wall are out-turned, and nozzle means operable to direct a gas along the inner faces of said portions of the ducting wall in a direction towards the interior of the ducting. Advantageously, the out-turned portions of the ducting wall are formed by providing lines of cut therein bounding the portions and then bending the portions outwardly to the desired dispositions.

The ducting is preferably of substantially uniform section over the length thereof extending from the out-turned portions. It may conveniently be provided by an extrusion process operated upon a metal or a plastics material. Suitably, the ducting is of rectilinear, preferably rectangular, cross-section with the major dimension somewhat in excess of the width of the web to be transported.

The out turned portions of the ducting wall may be substantially without curvature, that is to say they are substantially planar, for a major proportion of their length extending to their outer ends.

By use of the present invention there may be provided a pneumatic transporter of simple and inexpensive construction and which, although not having a Venturi form passage, operates fully efficiently.

In order that the invention may be clearly understood and readily carried into effect, reference will now be made, by way of example, to the accompanying diagrammatic drawings, in which.

Figure 1:
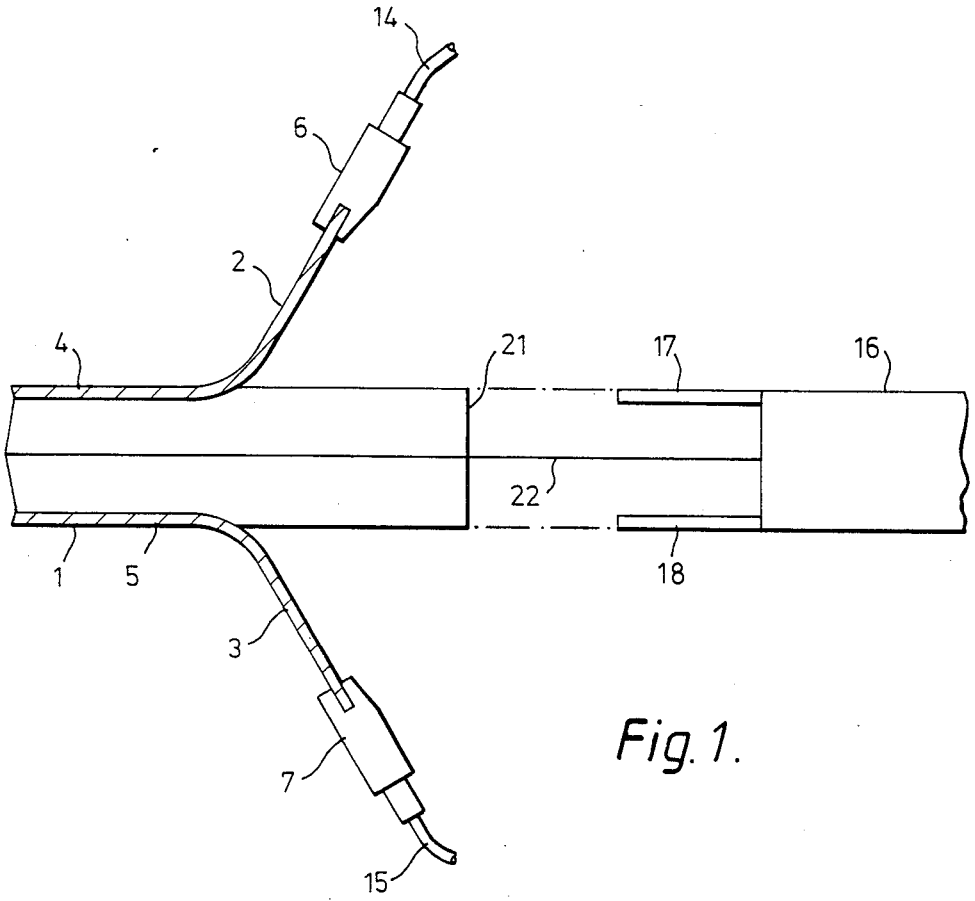
FIG. 1 shows, to the left of the figure, an upstream end portion of an air transporter, with ducting thereof in axial cross-section, and, to the right of the figure, a downstream end portion of a further air transporter.

The air transporter to the left of FIG. 1 comprises a 2 meter length of rectangular section ducting 1 of extruded aluminium. The interior dimensions of the ducting are 31 mm×12 mm, which is appropriate for the transport of cigarette paper of a width of 27 mm. Upper and lower portions 2, 3 of the ducting walls are out-turned. The out-turned portions 2, 3 were formed by providing lines of cut approximately 5 cm long in the upper and lower walls 4, 5 of the ducting 1, which lines of cut extended from the upstream end of the ducting 1. The lines of cut in each of the walls 4, 5 were parallel and spaced inwardly of the outer side surfaces of the ducting 1 a distance equivalent to the wall thickness of the ducting 1, that is to say they were separated by a distance of 31 mm. The portions 2, 3 were then bent outwardly until major planar proportions of the lengths thereof were disposed at about 60° to the horizontal axial plane of the ducting 1.

At the outer ends of the portions 2, 3 are mounted nozzle blocks 6, 7. The nozzle blocks 6, 7 are of moulded plastics construction and one of them is shown in somewhat more detail in FIGS. 2 and 3, to which reference is now directed. Across an outlet end face 8 of the nozzle block there opens a slot 9 dimensioned to provide an interference fit with the portions 2, 3 of the ducting 1. One wall of the slot 9 (the upper wall as viewing FIGS. 2 and 3) is provided with a relieved portion 10 such that when an outer end of a portion 2 or 3 is received in the slot 9, a slit orifice is defined by the relieved portion 10 and the opposed, inner face of the portion 2 or 3. The so defined slit orifice communicates at its inner end with a passage 11 extending within the nozzle block. At its inlet end, to the right as viewing FIG. 3, the passage 11 is of circular cross-section, whereas at its outlet end, in the plane of rear wall 12 of the slot 9, the cross-section has widened in conformity with the width of the relieved portion 10 of the slot 9.

Figure 2:
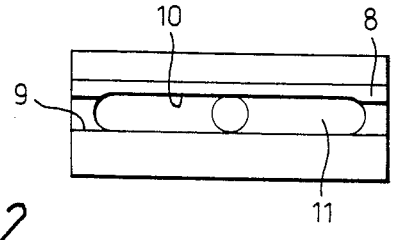
FIG. 2 shows, to a larger scale than the scale of FIG. 1, an outlet end of a nozzle block of the air transporter shown to the left of FIG. 1.
Figure 3:
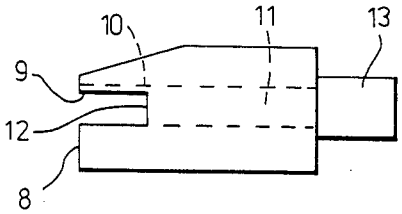
FIG. 3 shows a side elevation of the nozzle block of FIG. 2.

The nozzle block of FIGS. 2 and 3 comprises a socket 13 by means of which an air line (14, 15 in FIG. 1) may be received in quick release fashion. When received in socket 13 the line 14 or 15 serves to provide compressed air, from a source not shown, to the passage 11. The air is suitably at a pressure of between 10 and 15 pounds per square inch gauge.

Figure 4:
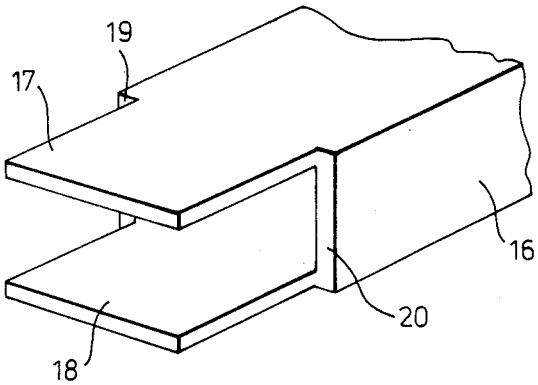
FIG. 4 shows an isometric view of the downstream end portion of the air transporter shown to the right of FIG. 1.

An air transporter system may comprise a number of air transporters. Heretofore it has been thought necessary where it is intended for the transported web to pass from one air transporter to another to have the downstream end of the first transporter spaced from the upstream end of the second transporter. Thus, for example, in the above mentioned Specification No. 1,338,440 the reader is taught that the space should not be less than twelve inches. It has been found though that with air transporters of the form shown in FIG. 1 the downstream end of one transporter may be coupled to the upstream end of another transporter whilst maintaining a fully effective web transport effect. A downstream end construction suitable for coupling with the upstream end of the air transporter shown to the left of FIG. 1 is depicted to the right of FIG. 1 and in FIG. 4.

The end construction was obtained by cutting away the side walls of ducting 16 from the downstream end for a distance of 3 cm so as to leave upper and lower tongues 17, 18 which are slidably receivable between the freely extending upstream end portions of the side walls of ducting 1. When coupling the two air transporters the tongues 17, 18 are advanced until shoulders 19, 20 of the ducting 16 contact the end faces of the side wall portions of ducting 1, one of which end faces is designated 21 in FIG. 1. The coupling may be secured by, for example, applying a channel shaped bracket (not shown) over the ducting 1 so as to force the end portions of the side walls thereof into gripping contact with the side edge surfaces of the tongues 17, 18. Such a bracket must, of course, be so dimensioned and positioned that it does not close or reduce the area of either of the upper and lower openings which extend between the outer ends of the tongues 17, 18 and the roots of the out-turned portions 2, 3.

The line referenced 22 in FIG. 1 represents the line of travel of a cigarette paper web. The direction of travel is towards the left as viewed in that figure.

An air transport system was constructed comprising eight air transporters as above described plus a U-bend air bearing of 30 cm diameter and four 90°-bend air bearings of 30 cm radius. Four of the air transporters were twisted through an angle of 90°, that is to say in the ducting of each of these the major dimension walls in one portion of the length of the ducting were perpendicular to the major dimension walls in another portion of the length of the ducting. It was found that with an air supply at 15 pounds per square inch gauge to each of the air transporters, cigarette paper presented at the inlet end of the system was threaded to the outlet end of the system at a speed of approximately 1.5 to 2 meters per second. When the air to the transporters was discontinued and air was supplied at 1.5 pounds per square inch gauge to the air bearings, it was found that the cigarette paper web could be pulled through the system at a speed of 9 meters per second or more. A speed of 9 meters per second is far in excess of the current upper end of the speed range of cigarette paper feed on cigarette making machines. The total length of the system was 19 meters, although the system would have remained effective if the length had been considerably increased.

The 60° disposition of the planar proportions of the out-turned portions 2, 3 was found to produce an efficient transporting effect. However, other angular dispositions, between 40° and 75° say, could be used.

It is convenient to provide air movers as above described each having air introduction means at the upstream end and having a ducting of a standard length not exceeding the maximum length over which stable web transport can be maintained with air introduced at a single air introduction means. However, it will be apparent from the mention above of the coupling of air movers constructed in accordance with the present invention that it is also possible to utilize longer lengths of ducting if air introduction means are provided at intervals not exceeding the said maximum length. For this purpose a pair of out-turned portions of walls of the ducting may be provided at a location distant from the upstream end thereof by forming pairs of lines of cut extending lengthwise of the ducting, the lines of cut of each pair, at the upstream ends thereof, being interconnected by a transverse line of cut.

Although as above described, out-turned pairs of wall portions are provided by first forming lines of cut in the ducting and subsequently bending out wall portions bounded by the lines of cut, it is conceivable that by using a casting or moulding technique, with a plastics material for example, a length of ducting could be provided having pre-formed pairs of out-turned wall portions.

We claim:

1. A pneumatic transporter comprising a length of ducting, with an interior at an inlet location of which oppositely disposed portions of the ducting wall are out-turned to form openings through which said ducting is open to the atmosphere, and nozzle means operable to direct a gas along the inner faces of said portions of the ducting wall in a direction toward the interior of the ducting.

2. A transporter according to claim 1, wherein said ducting is of substantially uniform section over the length thereof extending from the out-turned portions.

3. A transporter according to claim 1 or 2, wherein said ducting is of rectilinear cross-section.

4. A transporter according to claim 1, wherein each of the out-turned portions is substantially without curvature for a proportion of the length thereof extending to the outer end thereof.

5. A transporter according to claim 4, wherein each said proportion is disposed at an angle in the range of 40° to 75° to an axial plane of said ducting.

6. A transporter according to claim 1, two pairs of lines of cut having been made in said ducting, and the out-turned portions of the ducting wall having been provided by bending outwardly the portion of the ducting wall bounded by each of said pairs of lines of cut.

7. A transporter according to claim 6, wherein each of said lines of cut extended from the upstream end of said ducting.

8. A transporter according to claim 6, wherein each of the lines of cut of each of said pairs of lines of cut were interconnected at the upstream ends thereof by a third, transverse line of cut.

9. A transporter according to claim 1, said nozzle means being attached at an outer end region of each of the out-turned portions.

10. A transporter according to claim 1 wherein said nozzle means has a slit orifice having a major dimension oriented in parallel with an inner surface of said out-turned portions, said nozzle being arranged and positioned with the orifice adjacent said inner surface to produce a laminar air flow within the ducting.

* * * * *

UNITED STATES PATENT AND TRADEMARK OFFICE

CERTIFICATE OF CORRECTION

PATENT NO. : 4,582,455

DATED : April 15, 1986

INVENTOR(S) : Wladyslaw H. Krywiczanin et al.

It is certified that error appears in the above-identified patent and that said Letters Patent is hereby corrected as shown below:

Column 1, line 53, "out turned" should read -- out-turned --.

Signed and Sealed this

*Thirtieth* Day of *September 1986*

[SEAL]

*Attest:*

DONALD J. QUIGG

*Attesting Officer*

*Commissioner of Patents and Trademarks*